US006503872B1

(12) United States Patent
Tomaro

(10) Patent No.: US 6,503,872 B1
(45) Date of Patent: Jan. 7, 2003

(54) EXTENDED DRAIN MANUAL TRANSMISSION LUBRICANTS AND CONCENTRATES

(75) Inventor: Joseph A. Tomaro, Maple Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/643,801

(22) Filed: Aug. 22, 2000

(51) Int. Cl.[7] ..... C10M 141/10

(52) U.S. Cl. ..... 508/377; 508/378; 508/380; 508/391; 508/408

(58) Field of Search ..... 508/377, 380, 508/378, 391, 408

(56) References Cited

U.S. PATENT DOCUMENTS

| | | | | | |
|---|---|---|---|---|---|
| 3,652,410 | A | | 3/1972 | Hollinghurst et al. | 252/32.7 |
| 4,528,108 | A | * | 7/1985 | Grover | 508/377 |
| 4,704,216 | A | * | 11/1987 | Hata et al. | 508/377 |
| 4,792,410 | A | * | 12/1988 | Schwind et al. | 508/377 |
| 5,198,129 | A | * | 3/1993 | Hata | 508/377 |
| 5,523,005 | A | | 6/1996 | Di Biase et al. | 252/18 |
| 5,883,057 | A | * | 3/1999 | Roell, Jr. et al. | 508/469 |
| 6,103,673 | A | * | 8/2000 | Sumiejski et al. | 508/195 |

FOREIGN PATENT DOCUMENTS

| | | | |
|---|---|---|---|
| EP | 0237804 | * | 9/1987 |
| EP | 0 552 863 A2 | | 7/1993 |
| EP | 0 753 564 A1 | | 1/1997 |
| EP | 0 776 964 A1 | | 6/1997 |
| EP | 0 987 311 A2 | | 3/2000 |
| GB | 2 053 920 A | | 2/1981 |
| WO | 00/26328 | | 5/2000 |

OTHER PUBLICATIONS

International Search Report, Application No. PCT/US01/26285, dated Jun. 19, 2002.

* cited by examiner

*Primary Examiner*—Jacqueline V. Howard
(74) *Attorney, Agent, or Firm*—William C. Tritt; Michael F. Esposito; Teresan W. Gilbert

(57) ABSTRACT

This invention relates to a manual transmission lubricants comprising a major amount of an oil of lubricating viscosity, (A) at least one metal thiophosphate, (B) at least one phosphite, and (C) at least one basic salt of an acidic organic compound. In another embodiment, the manual transmission further comprises at least metal salt of a phenol. The lubricants provide the antiwear and extreme pressure protection needed for the manual transmission without harming the manual transmission components.

18 Claims, No Drawings

EXTENDED DRAIN MANUAL TRANSMISSION LUBRICANTS AND CONCENTRATES

FIELD OF THE INVENTION

This invention relates to manual transmission lubricants which are thermally and oxidatively stable and are effective even at long drain intervals. More specifically, the invention relates to manual transmission lubricants with a metal thiophosphate, a phosphite and a basic salt of an acidic organic compound which provide thermal and oxidation protection to the manual transmission lubricants.

BACKGROUND OF THE INVENTION

Manual transmissions pose problems for lubricant formulators because of the configuration of the transmission and the metallurgy of the transmission components. The manual transmission uses spur gears which provided pressure and shearing in essentially linear force lines. In other words, the force of shear has only one directional component. This is in contrast to gears used for the driveline which are hypoid gears. In a hypoid gear, the gears mesh in such a way that the shearing force has two directional components'. A linear component and a second transverse component across the gear face. The level of extreme pressure protection needed for a manual transmission is lower than that needed for a hypoid gear assembly.

The manual transmission requires certain frictional properties from the lubricant to provide the ability of the manual transmission to perform gear changes. For the gear to be changed, the transmission must bring the drive shaft and the gear into position for meshing. The meshing is accomplished by a synchronizer when the synchronizing parts (plate to plate or ring to cone) are reduced to relative zero velocity. If these parts do not obtain zero relative velocity, then a phenomenon known as synchronizer clashing (sometimes referred to as crashing) occurs. Clashing of the synchronizer results when the dynamic coefficient of friction building between the engaging synchronizer parts (plate to plate or ring to cone) falls below a critical minimum value. Below this critical minimum value the synchronizer parts do not attain zero relative velocity and the lockup mechanism (e.g., spline camphers) contacts the rotating member (e.g., cone camphers) resulting in a loud noise (clashing/crashing).

The components of the manual transmission are typically bronze or brass. These metals are susceptible to corrosion and chemical attack from typical antiwear and extreme pressure agents which contain sulfur, particularly active sulfur. For instance, organic polysulfides which are typically used with lubricants for hypoid gears cause damage to the manual transmission synchronizer components.

Previously, manual transmission lubricants would use metal thiophosphonates or antiwear agents. These metal salts were typically barium salts. The accumulation of heavy metals, such as barium, in the environment has lead to the desire to eliminate the use of heavy metal salts in manual transmission lubricants.

It is desirable to provide lubricants which can provide the antiwear protection and viscosity protection for manual transmissions without harming the components of the transmission. It is desirable that the lubricants be free of barium salts.

SUMMARY OF THE INVENTION

This invention relates to a manual transmission lubricants comprising a major amount of an oil of lubricating viscosity, (A) at least one metal thiophosphate, (B) at least one phosphite, and (C) at least one basic salt of an acidic organic compound. In another embodiment, the manual transmission further comprises at least metal salt of a phenol. The lubricants provide the antiwear and extreme pressure protection needed for the manual transmission without harming the manual transmission components.

DETAILED DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. parietal, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is purely hydrocarbon.

As described above the lubricating compositions comprise (A) at least one metal thiophosphate, (B) at least one hydrocarbyl phosphite, and (C) at least one overbased salt of an acidic organic compound. These lubricants provide thermal and oxidative protection as well at antiwear and extreme pressure protection to machinery.

Metal Thiophosphates

The manual transmission lubricants, and concentrates include at least one metal thiophosphate. Typically, the metal thiophosphate is present at a level from about 0.1% to about 5%, or from about 0.3% or to about 4%, or from about 0.5% to about 3%, or from 0.7% to about 2% by weight in the lubricating composition. Here and elsewhere in the specification and claims, the range and ratio limits may be combined.

The metal thiophosphates include mono and dithiophosphates as well as mixtures of mono and dithiophosphates. The mixtures may be formed in situ reaction or may be formed by blending a metal monothiophosphate with a metal dithiophosphate. The monothiophosphates or mixtures of mono and dithiophosphates may also be formed through reacting a metal dithiophosphate with steam. Alternatively, the monothiophosphate may be prepared by reacting one or more of the phosphites discussed herein with a sulfur or a sulfur compound.

In one embodiment, the metal thiophosphate is represented by the formula

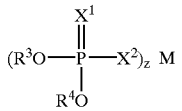

wherein where $X^1$ and $X^2$ are independently oxygen or sulfur provided that one of these is sulfur, R3 and R4 are each independently hydrocarbyl groups containing from 3 to about 13 carbon atoms, preferably from 3 to about 8, M is a metal, and z is an integer equal to the valence of M. Preferably both $X^1$ and $X^2$ are sulfur.

The hydrocarbyl groups $R^3$ and $R^4$ in the thiophosphate may be alkyl, cycloalkyl, aralkyl or alkaryl groups. Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkylkyclohexyl radicals. Many substituted hydrocarbon groups may also be used, e.g., chloropentyl, di-chlorophenyl, and dichlorodecyl.

The thiophosphoric acids from which the metal salts useful in this invention are prepared are well known. Examples of dihydrocarbyl dithiophosphoric acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The thiophosphoric acids are prepared by the reaction of a phosphorus sulfide with an alcohol or phenol or mixtures of alcohols. Useful phosphorus sulfide-containing sources include phosphorus pentasulfide, phosphorus sesquisulfide, phosphorus heptasulfide and the like. The reaction involves four moles of the alcohol or phenol per mole of phosphorus pentasulfide, and may be carried out within the temperature range from about 50° C. to about 200° C. Thus the preparation of O,O-di-n-hexyl dithiophosphoric acid involves the reaction of phosphorus pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two reactants is sufficient to cause the reaction to take place and the resulting product is sufficiently pure for the purposes of this invention.

The metal salts of dihydrocarbyl dithiophosphates which are useful in this invention include those salts containing Group I metals, Group II metals, aluminum, lead, tin, molybdenum, manganese, cobalt, and nickel. Group I and Group II (including Ia, Ib, IIa and IIb) are defined in the Periodic Table of the Elements in the Merck Index, 9th Edition (1976). The Group II metals, aluminum, tin, iron, cobalt, lead, molybdenum, manganese, nickel and copper are among the preferred metals. Zinc and copper are especially useful metals. In one embodiment, the lubricating compositions contain a zinc dihydrocarbyl dithiophosphate and a copper dihydrocarbyl dithiophosphate. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, copper oxide, lead hydroxide, tin butylate, cobalt hydroxide, nickel hydroxide, nickel carbonate, zinc oxide, etc.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc dithiophosphate.

In one preferred embodiment, the alkyl groups $R^3$ and $R^4$ are derived from secondary alcohols such as isopropyl alcohol, secondary butyl alcohol, 2-pentanol, 2-methyl4-pentanol, 2-hexanol, 3-hexanol, isooctyl etc.

Especially useful metal dithiophosphates can be prepared from dithiophosphoric acids which in turn are prepared by the reaction of phosphorus pentasulfide with mixtures of alcohols. In addition, the use of such mixtures enables the utilization of cheaper alcohols which in themselves may not yield oil-soluble dithiophosphoric acids or salts thereof. Thus a mixture of isopropyl and hexyl alcohols can be used to produce a very effective, oil-soluble metal dithiophosphate. For the same reason mixtures of dithiophosphoric acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl4-pentanol; isopropanol and sec-butyl alcohol; isopropanol and isooctyl alcohol; etc.

The following examples illustrate the preparation of metal dithiophosphates.

EXAMPLE A-1

A dithiophosphoric acid is prepared by reacting a mixture of alcohols comprising 6 moles of 4-methyl-2-pentanol and 4 moles of isopropyl alcohol with phosphorus pentasulfide. The dithiophosphoric acid then is reacted with an oil slurry of zinc oxide. The amount of zinc oxide in the slurry is about 1.08 times the theoretical amount required to completely neutralize the dithiophosphoric acid. The oil solution of the zinc dithiophosphate obtained in this manner (10% oil) contains 9.5% phosphorus, 20.0% sulfur and 10.5% zinc.

Additional specific examples of metal dithiophosphates useful in the lubricating oils of the present invention are listed in the following table. These metal dithiophosphates are prepared by the general procedure of Example A-1.

TABLE

Component A: Metal Dithiophosphates

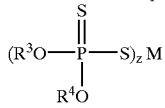

| Example | $R^3$ | $R^4$ | M | z |
|---|---|---|---|---|
| A-2 | (isopropyl + isooctyl) $(60:40)_m$ | | Zn | 2 |
| A-3 | n-nonyl | n-nonyl | Ba | 2 |

TABLE-continued

Component A: Metal Dithiophosphates

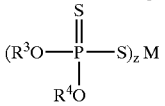

| Example | $R^3$ | $R^4$ | M | z |
|---|---|---|---|---|
| A-4 | cyclohexyl | cyclohexyl | Zn | 2 |
| A-5 | isobutyl | isobutyl | Zn | 2 |
| A-6 | isooctyl | isooctyl | Zn | 2 |
| A-7 | n-decyl | n-decyl | Zn | 2 |
| A-8 | 4-methyl-2-pentyl | 4-methyl-2-pentyl | Cu | 2 |
| A-9 | (n-butyl + dodecyl) (1:1)w | | Zn | 2 |
| A-10 | (isopropyl + isooctyl) (1:1)w | | Zn | 2 |
| A-11 | (isopropyl + 4-methyl-2 pentyl) + (40:60)m | | Cu | 2 |
| A-12 | (isobutyl + isoamyl) (65:35)m | | Zn | 2 |
| A-13 | (isopropyl + sec-butyl) (40:60)m | | Zn | 2 |

Another class of the thiophosphate additives contemplated for use in the lubricating composition of this invention comprises the adducts of the metal dithiophosphates described above with an epoxide. The metal dithiophosphates useful in preparing such adducts are for the most part the zinc dithiophosphates. The epoxides may be alkylene oxides or arylalkylene oxides. The arylalkylene oxides are exemplified by styrene oxide, p-ethylstyrene oxide, alpha-methylstyrene oxide, 3-beta-naphthyl-1,1,3-butylene oxide, m-dodecylstyrene oxide, and p-chlorostyrene oxide. The alkylene oxides include principally the lower alkylene oxides in which the alkylene radical contains 8 or less carbon atoms. Examples of such lower alkylene oxides are ethylene oxide, propylene oxide, 1,2-butene oxide, trimethylene oxide, tetramethylene oxide, butadiene monoepoxide, 1,2-hexene oxide, and epichlorohydrin. Other epoxides useful herein include, for example, butyl 9,10-epoxy-stearate, epoxidized soya bean oil, epoxidized tung oil, and epoxidized copolymer of styrene with butadiene.

The adduct may be obtained by simply mixing the metal dithiophosphate and the epoxide. The reaction is usually exothermic and may be carried out within wide temperature limits from about 0° C. to about 300° C. Because the reaction is exothermic, it is best carried out by adding one reactant, usually the epoxide, in small increments to the other reactant in order to obtain convenient control of the temperature of the reaction. The reaction may be carried out in a solvent such as benzene, toluene, xylene, mineral oil, naphtha, or n-hexene.

The chemical structure of the adduct is not known. For the purpose of this invention adducts obtained by the reaction of one mole of the dithiophosphate with from about 0.25 mole to 5 moles, usually up to about 0.75 mole or about 0.5 mole of a lower alkylene oxide, particularly ethylene oxide and propylene oxide, have been found to be especially useful and therefore are preferred.

The preparation of such adducts is more specifically illustrated by the following examples.

EXAMPLE A-14

A reactor is charged with 2365 parts (3.33 moles) of the zinc isopropyl-isooctyl dithiophosphate (wherein the molar ratio of isopropyl to isooctyl is (1:0.7)), and while stirring at room temperature, 38.6 parts (0.67 mole) of propylene oxide are added with an exotherm of from 24–31° C. The mixture is maintained at 80–90° C. for 3 hours and then vacuum stripped to 101° C. at 7 mm.Hg. The residue is filtered using a filter aid, and the filtrate is an oil solution (11.8% oil) of the desired salt containing 17.1% sulfur, 8.17% zinc and 7.44% phosphorus.

Another class of the dithiophosphate additives contemplated as useful in the lubricating compositions of the invention comprises mixed metal salts of (a) at least one dithiophosphoric acid as defined above and (b) at least one aliphatic or alicyclic carboxylic acid. The carboxylic acid may be a monocarboxylic or polycarboxylic acid, usually containing from 1 to about 3 carboxy groups, preferably one. It may contain from about 2 to about 40, preferably from about 2 to about 20 carbon atoms, and advantageously about 5 to about 20 carbon atoms. The carboxylic acid may be any of the above-described carboxylic acids. The preferred carboxylic acids are those having the formula $R^5COOH$, wherein $R^5$ is an aliphatic or alicyclic hydrocarbon-based radical preferably free from acetylenic unsaturation. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer. For the most part, $R^5$ is a saturated aliphatic group and especially a branched alkyl group such as the isopropyl or 3-heptyl group. Illustrative polycarboxylic acids are succinic, alkyl- and alkenylsuccinic, adipic, sebacic and citric acids.

The mixed metal salts may be prepared by merely blending a metal salt of a dithiophosphoric acid with a metal salt of a carboxylic acid in the desired ratio. The ratio of equivalents of dithiophosphoric to carboxylic acid salts is between about 0.5:1 to about 400:1. Preferably, the ratio is between about 0.5:1 and about 200:1. Advantageously, the ratio can be from about 0.5:1 to about 100:1, preferably from about 0.5:1 to about 50:1, and or from about 0.5:1 to about 20:1. Further, the ratio can be from about 0.5:1 to about 4.5:1, preferably about 2.5:1 to about 4.25:1. For this purpose, the equivalent weight of a dithiophosphoric acid is its molecular weight divided by the number of -PSSH groups therein, and that of a carboxylic acid is its molecular weight divided by the number of carboxy groups therein.

A second and preferred method for preparing the mixed metal salts useful in this invention is to prepare a mixture of the acids in the desired ratio and to react the acid mixture with one of the above described metal compounds. When this method of preparation is used, it is frequently possible to prepare a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

Variants of the above-described methods may also be used to prepare the mixed metal salts useful in this invention. For example, a metal salt of either acid may be blended with an acid of the other, and the resulting blend reacted with additional metal base.

The temperature at which the mixed metal salts are prepared is generally between about 30° C. and about 150° C., preferably up to about 125° C. If the mixed salts are prepared by neutralization of a mixture of acids with a metal base, it is preferred to employ temperatures above about 50° C. and especially above about 75° C. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the mixed metal salt as an additive for lubricants or functional fluids.

U.S. Pat. Nos. 4,308,154 and 4,417,990 describe procedures for preparing these mixed metal salts and disclose a number of examples of such mixed salts. Such disclosures of these patents are hereby incorporated by reference.

The preparation of the mixed salts is illustrated by the following example.

EXAMPLE A-15

A mixture of 67 parts (1.63 equivalents) of zinc oxide and 48 parts of mineral oil is stirred at room temperature and a mixture of 401 parts (1 equivalent) of di-(2-ethylhexyl) dithiophosphoric acid and 36 parts (0.25 equivalent) of 2-ethylhexanoic acid is added over 10 minutes. The temperature increases to 40° C. during the addition. When addition is complete, the temperature is increased to 80° C. for 3 hours. The mixture is then vacuum stripped at 100° C. to yield the desired mixed metal salt as a 91% solution in mineral oil.

In another embodiment, one or more of the above metal thiophosphates are mixed with olefinic compound which may react with active sulfur. These compositions include the mixed metal thiophosphate and olefinic compound as well as the reaction product where the olefinic compound has reacted, at least in part, with active sulfur.

The olefinically unsaturated compounds of the present invention are those compounds that are capable of reacting with active sulfur. These compounds are diverse in nature. They contain at least one olefinic double bond, which is defined as a non-aromatic double bond; that is, one connecting two aliphatic carbon atoms. Olefinic compounds include olefins, unsaturated amines and amides, unsaturated carboxylic acids and anhydrides, such as fatty acids and esters, having from about 3 to about 70 carbon atoms, preferably from about 8 to 36 carbon atoms and especially from about 8 to about 20 carbon atoms are desirable. The aliphatic mono-1-olefin or alpha-olefin (i.e., terminal olefin) is one which is unbranched on the olefinic carbon atoms; that is, which contains the moiety CH2.dbd.CH—. It also usually contains substantially no branching on the allylic carbon atoms; that is, it preferably contains the moiety CH2 .dbd.CHCH2—. Preferred mono-1-olefins or alpha-olefins have about 8 to about 20, preferably about 15 to about 18 carbon atoms. Mixtures of these olefins are commercially available and such mixtures are suitable for use in this invention.

Exemplary of mono-1-olefins or alpha-olefins are 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, 1-pentacosene, 1-hexacosene, 1-octacosene, 1-nonacosene, etc. Exemplary of commercially available alpha olefin mixtures are C15–18 alpha-olefins, C12–16 alpha-olefins, C14–16 alpha-olefins, C14–18 alpha-olefins, C16–18 alpha-olefins, C16–20 alpha olefins, C22–28 alpha-olefins, etc. Additionally, C30+ alpha-olefin fractions such as those available from Gulf Oil Company under the name Gulftene can be used.

Mono-olefins which are suitable for use in accordance with the present invention can be derived from the cracking of paraffin wax. The wax cracking process yields both even and odd number C6–20 liquid olefins of which 85 to 90 percent are straight chain 1-olefins. The balance of the cracked wax olefins is made up of internal olefins, branched olefins, diolefins, aromatics and impurities. Distillation of the C6–20 liquid olefins obtained from the wax cracking process yields fractions (i.e., C15–18 alpha-olefins) which are particularly useful in accordance with this invention.

Other mono-olefins can be derived from the ethylene chain growth process. This process yields even numbered straight chain 1-olefins from a controlled Ziegler polymerization.

Other methods for preparing the mono-olefins of this invention include chlorination-dehydrochlorination of paraffins and catalytic dehydrogenation of paraffins.

The above procedures for the preparation of mono-olefins are well known to those of ordinary skill in the art and are described in detail under the heading "Olefins" in the Encyclopedia of Chemical Technology, Second Edition, Kirk and Othmer, Supplement, Pages 632–657, Interscience Publishers, Div. of John Wiley and Son, 1971, which is hereby incorporated by reference for its relevant disclosures pertaining to methods for preparing mono-olefins.

Also, fatty acid esters or amides derived from one or more unsaturated carboxylic acids are particularly useful as the olefinically unsaturated compounds.

The term "fatty acid" as used herein refers to acids which may be obtained by hydrolysis of a naturally occurring vegetable or animal fat or oil. These are usually in the C16–20 range and include oleic acid, linoleic acid and the like.

Fatty acid amides that are useful include oleamide (sometimes referred to as oleyl amide), N,N-dimethyl oleamide, N,N-bis(2-hydroxyethyl)oleamide, and N,N-di-n-butyl oleamide.

Fatty acid esters which are useful are primarily esters of aliphatic alcohols, including monohydric alcohols such as methanol, ethanol, 1-propanol, 2-propanol, the butanols, etc., and polyhydric alcohols including ethylene glycol, propylene glycol, trimethylene glycol, neopentyl glycol, glycerol and the like. The polyhydric alcohols can be partially or fully esterified. Particularly preferred are fatty oils derived predominantly from unsaturated acids, that is, triglycerides of long chain unsaturated carboxylic acids, especially linoleic and oleic acids. These fatty oils include such naturally occurring animal and vegetable oils as lard oil, peanut oil, cotton seed oil, soybean oil, corn oil, palm oil, sunflower oil, and the like. Mixtures of two or more of these fatty oils can also be used.

The composition and nature of fatty oils is well known to those of ordinary skill in the art and can be found in more detail in M. P. Doss, Properties of the Principal Fats, Fatty Oils, Waxes, Fatty Acids and Their Salts, The Texas Company, 1952, which is hereby incorporated by reference for its description of the fatty oils and unsaturated carboxylic acids useful for this invention.

Mixtures of fatty acid esters and mono-olefins can be used in accordance with the present invention. A particularly preferred mixture is that of C15–18 alpha-olefins and soybean oil.

The equivalent weight of component (B) can be determined by dividing its molecular weight by the number of olefinic double bonds present. The number of equivalents of component (B) can be determined by dividing the weight of component (B) by its equivalent weight. The ratio of equivalents of component (A) to equivalents of component (B) is in the range of about 1000:1 to about 1:5, preferably about 500:1 to about 1:3, or about 100:1 to about 1:3, and or about 50:1 to about 1:3. In a particularly advantageous embodiment, the ratio of equivalents of component (A) to equivalents of component (B) is about 25:1.

These products are described in U.S. Pat. No. 4,507,215, issued in the name of Schroeck. This patent is hereby incorporated by reference for these teachings, including the thiophosphates, olefinic compounds and methods of making the compositions.

Phosphite

The manual transmission lubricants also includes (B) at least one phosphite. In one embodiment, the phosphite is a di- or trihydrocarbyl phosphite. The phosphite is generally present in an amount from about 0.05 to about 3, or from about 0.1 to about 2, or from about 0.2 to about 1.5, or from about 0.2 to about 0.7 percent by weight. Preferably each hydrocarbyl group has from 1 to about 24 carbon atoms, or from 1 to about 18 carbon atoms, or from about 2 to about 8 carbon atoms. Each hydrocarbyl group may be independently alkyl, alkenyl, aryl, and mixtures thereof. When the hydrocarbyl group is an aryl group, then it contains at least about 6 carbon atoms; or from about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. Preferably each hydrocarbyl group is independently propyl, butyl, pentyl, hexyl, heptyl, oleyl or phenyl, or butyl, oleyl or phenyl and or butyl, oleyl, or phenyl. Phosphites and their preparation are known and many phosphites are available commercially. Particularly useful phosphites are dibutyl hydrogen phosphite, dioleyl hydrogen phosphite, di($C_{14-18}$) hydrogen phosphite, and triphenyl phosphite.

Basic Metal Salt

The manual transmission lubricants contains (C) at least one basic alkali or alkaline earth metal salt of an acidic organic compound. The basic metal salt is typically present in an amount from about 0.01 to about 3, or from about 0.05 to about 1.5, or from about 0.1 to about 1, or from about 0.1 to about 0.5 present by weight. In one embodiment, the acidic organic compound is phosphorus free and other than a metal thiophosphonate.

These salts are generally referred to as overbased materials. Overbased materials are single phase, homogeneous Newtonian systems characterized by a metal content in excess of that which would be present according to the stoichiometry of the metal and the particular acidic organic compound reacted with the metal.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of about 1.5, or about 3, or about 7, up to about 40, or about 25, or about 20.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents. Total base number is determined by titration of one gram of overbased material with 0.1 Normal hydrochloric acid solution using bromophenolblue as an indicator. The overbased materials of the present invention generally have a total base number of at least about 20, or about 100, or about 200. The overbased material generally have a total base number up to about 600, or about 500, or about 400.

In one embodiment, the total base number is essential to the invention because the inventors have discovered that the ratio of the equivalents of overbased material based on total base number to the equivalents of hydrocarbyl phosphite based on phosphorus atoms must be at least one to make the thermally stable lubricating compositions of the present invention. The equivalents of overbased material is determined by the following equation: equivalent weight=(56,100/total base number). For instance, an overbased material with a total base number of 200 has an equivalent weight of 280.5 (eqwt=56100/200). The equivalents of phosphite are determined by dividing the molecular weight of the phosphite by the number of phosphorus atoms in the phosphite.

The overbased materials (C) are prepared by reacting an acidic material (typically an inorganic acid or lower carboxylic acid, or carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter.

The acidic organic compounds useful in making the overbased compositions of the present invention include carboxylic acids, sulfonic acids, phosphorus-containing acids, phenols or mixtures of two or more thereof. Or, the acidic organic compounds are carboxylic acids or sulfonic acids with sulfonic and salicylic acids more preferred. Throughout this specification and in the appended claims, any reference to acids, such as carboxylic, or sulfonic acids, is intended to include the acid-producing derivatives thereof such as anhydrides, lower alkyl esters, acyl halides, lactones and mixtures thereof unless otherwise specifically stated.

The carboxylic acids useful in making the overbased salts (C) of the invention may be aliphatic or aromatic, mono- or polycarboxylic acid or acid-producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids.

The carboxylic acids of this invention are or oil-soluble. Usually, in order to provide the desired oil-solubility, the number of carbon atoms in the carboxylic acid should be at least about 8, or at least about 18, or at least about 30, or at least about 50. Generally, these carboxylic acids do not contain more than about 400 carbon atoms per molecule.

The lower molecular weight monocarboxylic acids contemplated for use in this invention include saturated and unsaturated acids. Examples of such useful acids include dodecanoic acid, decanoic acid, oleic acid, stearic acid, linoleic acid, tall oil acid, etc. Mixtures of two or more such agents can also be used. An extensive discussion of these acids is found in Kirk- Othmer "Encyclopedia of Chemical Technology" Third Edition, 1978, John Wiley & Sons New York, pp. 814–871; these pages being incorporated herein by reference.

The monocarboxylic acids include isoaliphatic acids. Such acids often contain a principal chain having from about 14 to about 20 saturated, aliphatic carbon atoms and at least one but usually no more than about four pendant acyclic lower alkyl groups. Specific examples of such isoaliphatic acids include 10-methyl-tetradecanoic acid, 3-ethyl-hexadecanoic acid, and 8-methyl-octadecanoic acid. The isoaliphatic acids include mixtures of branch-chain acids prepared by the isomerization of commercial fatty acids (oleic, is linoleic or tall oil acids) of, for example, about 16 to about 20 carbon atoms.

High molecular weight carboxylic acids may also be used in the present invention. These acids have a substituent group derived from a polyalkene. The polyalkene is characterized as containing at least about 30 carbon atoms, or at least about 35, or at least about 50, and up to about 300 carbon atoms, or about 200, or about 150. In one embodiment, the polyalkene is characterized by an Mn (number average molecular weight) value of at least about 500, generally about 500 to about 5000, or about 800 to about 2500. In another embodiment, Mn varies between about 500 to about 1200 or 1300.

The polyalkenes include homopolymers and interpolymers of polymerizable olefin monomers of 2 to about 16 carbon atoms. The olefins may be monoolefins such as ethylene, propylene, 1-butene, isobutene, and 1-octene; or a polyolefinic monomer, or diolefinic, monomer such 1,3-butadiene and isoprene. Or the monomers contain from 2 to about 6 carbon atoms, or 2 to about 4, or 4. The interpolymers include copolymers, terpolymers, tetrapolymers and the like. Or, the interpolymer is a homopolymer. An example of a preferred homopolymer is a polybutene, preferably a polybutene in which about 50% of the polymer is derived from isobutylene. The polyalkenes are prepared by conventional procedures.

The higher molecular weight mono and polycarboxylic acids suitable for use in making the overbased salts (C) are well known in the art and have been described in detail, for example, in the following U.S., British and Canadian patents: U.S. Pat. Nos. 3,024,237; 3,172,892; 3,219,666; 3,245,910; 3,271,310; 3,272,746; 3,278,550; 3,306,907; 3,312,619; 3,341,542; 3,367,943; 3,374,174; 3,381,022; 3,454,607; 3,470,098; 3,630,902; 3,755,169; 3,912,764; and 4,368,133; British Patents 944,136; 1,085,903; 1,162,436; and 1,440,219; and Canadian Patent 956,397. These patents are incorporated herein by reference for their disclosure of higher molecular weight mono- and polycarboxylic acids and methods for making the same.

Illustrative carboxylic acids include palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene (Mn=200–1500, or 300–1000), polypropenyl-substituted succinic acid derived from a polypropene, (Mn=200–1000, or 300–900), octadecyl-substituted adipic acid, chlorostearic acid, 9-methylstearic acid, dichlorostearic acid, stearyl-benzoic acid, eicosanyl-substituted naphthoic acid, dilauryl-decahydronaphthalene carboxylic acid, mixtures of any of these acids, their alkali and alkaline earth metal salts, and/or their anhydrides. A preferred group of aliphatic carboxylic acids includes the saturated and unsaturated higher fatty acids containing from about 12 to about 30 carbon atoms. Illustrative of these acids are lauric acid, palmitic acid, oleic acid, linoleic acid, linolenic acid, oleostearic acid, stearic acid, myristic acid, and undecalinic acid, alpha-chlorostearic acid, and alphanitrolauric acid.

In another embodiment, the carboxylic acid is an alkylalkyleneglycol-acetic acid, or alkylpolyethyleneglycol-acetic acid. Some specific examples of these compounds include: iso-stearylpentaethyleneglycol-acetic acid; iso-stearyl-O-$(CH_2CH_2O)_5CH_2CO_2Na$; lauryl-O-$(CH_2CH_2O)_{2.5}$-$CH_2CO_2H$; lauryl-O-$(CH_2CH_2O)_{3.3}CH_2CO_2H$; oleyl-O-$(CH_2C\text{-}H_2O)_4$-$CH_2CO_2H$; lauryl-O-$(CH_2CH_2O)_{4.5}CH_2CO_2H$; lauryl-O-$(CH_2CH_2O)_{10}CH_2CO_2H$; lauryl-O-$(CH_2CH_2)_{16}CH_2CO_2H$; octyl-phenyl-O-$(CH_2CH_2O)_8CH_2CO_2H$; octyl-phenyl-O-$(CH_2CH_2O)_{,19}CH_2CO_2H$; 2-octyl-decanyl-O-$(CH_2CH_2O)_6CH_2CO_2H$. These acids are available commercially from Sandoz Chemical under the tradename Sandopan acids.

In another embodiment, the carboxylic acids are aromatic carboxylic acids. A group of useful aromatic carboxylic acids are those of the formula

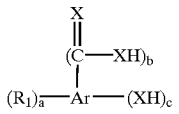

wherein $R_1$ is an aliphatic hydrocarbyl group of preferably about 4 to 400 carbon atoms, a is a number in the range of zero to about 4, usually 1 or 2, Ar is an aromatic group, each X is independently sulfur or oxygen, preferably oxygen, b is a number in the range of from 1 to about 4, usually 1 or 2, c is a number in the range of zero to about 4, usually 1 to 2, with the proviso that the sum of a, b and c does not exceed the number of valences of Ar. Preferably, $R_1$ and a are such that there is an average of at least about 8 aliphatic carbon atoms provided by the $R_1$ groups. Examples of aromatic carboxylic acids include substituted and non-substituted benzoic, phthalic and salicylic acids or anhydrides.

The $R_1$ group is a hydrocarbyl group that is directly bonded to the aromatic group Ar. $R_1$ preferably contains about 6 to about 80 carbon atoms, preferably about 6 to about 30 carbon atoms, or about 8 to about 25 carbon atoms, and advantageously about 8 to about 15 carbon atoms. $R_1$ groups may be derived form one or more of the above-described polyalkenes. Examples of $R_1$ groups include butyl, isobutyl, pentyl, octyl, nonyl, dodecyl, 5-chlorohexyl, 4ethoxypentyl, 3-cyclohexyloctyl, 2,3,5-trimethylheptyl, and substituents derived from polymerized olefins such as polyethylenes, polypropylenes, polyisobutylenes, ethylene-propylene copolymers, chlorinated olefin polymers, oxidized ethylene-propylene copolymers, propylene tetramer and tri(isobutene).

Examples of the $R_1$ groups include butyl, isobutyl, pentyl, octyl, nonyl, dodecyl, and substituents derived from the above-described polyalkenes such as polyethylenes, polypropylenes, polyisobutylenes, ethylene-propylene copolymers, oxidized ethylene-propylene copolymers, and the like.

The aromatic group Ar may have the same structure as any of the aromatic groups Ar discussed below. Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Within this group of aromatic acids, a useful class of carboxylic acids are those of the formula

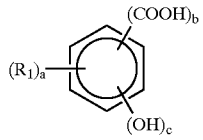

wherein $R_1$ is defined above, a is a number in the range of from zero to about 4, preferably 1 to about 2; b is a number in the range of 1 to about 4, preferably 1 to about 2, c is a number in the range of zero to about 4, preferably 1 to about 2, and or 1; with the proviso that the sum of a, b and c does not exceed 6. Preferably, $R_1$ and a are such that the acid molecules contain at least an average of about 12 aliphatic carbon atoms in the aliphatic hydrocarbon substituents per acid molecule. Preferably, b and c are each one and the carboxylic acid is a salicylic acid.

The salicylic acids can be aliphatic hydrocarbon-substituted salicyclic acids wherein each aliphatic hydrocarbon substituent contains an average of at least about 8 carbon atoms per substituent and 1 to 3 substituents per molecule. Overbased salts prepared from such salicyclic acids wherein the aliphatic hydrocarbon substituents are derived from the above-described polyalkenes, particularly polymerized lower 1-mono-olefins such as polyethylene, polypropylene, polyisobutylene, ethylene/propylene copolymers and the like and having average carbon contents of about 30 to about 400 carbon atoms are particularly useful.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

The sulfonic acids useful in making the overbased salts (C) of the invention include the sulfonic and thiosulfonic acids. Generally they are salts of sulfonic acids. The sulfonic acids include the mono- or polynuclear aromatic or cycloaliphatic compounds. The oil-soluble sulfonates can be represented for the most part by one of the following formulae: $R_2$—T—$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight (Mn) in the range of 500 to 5000, preferably 800 to 2000, or about 1500 with chlorosulfonic acid, nitronaphthalene sulfonic acid, paraffin wax sulfonic acid, cetyl-cyclopentane, sulfonic acid, lauryl-cyclohexane sulfonic acids, polyethylenyl-substituted sulfonic acids derived from polyethylene (Mn=300–1000, preferably 750), etc. Normally the aliphatic groups will be alkyl and/or alkenyl groups such that the total number of aliphatic carbons is at least about 8, preferably at least 12 up to about 400 carbon atoms, preferably about 250.

Another group of sulfonic acids are mono- , di- , and tri-alkylated benzene and naphthalene (including hydrogenated forms thereof) sulfonic acids. Illustrative of synthetically produced alkylated benzene and naphthalene sulfonic acids are those containing alkyl substituents having from about 8 to about 30 carbon atoms, preferably about 12 to about 30 carbon atoms, and advantageously about 24 carbon atoms. Such acids include di-isododecylbenzene sulfonic acid, polybutenyl-substituted sulfonic acid, polypropylenyl-substituted sulfonic acids derived from polypropene having an Mn=300–1000, preferably 500–700, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide suffonic acids, dilauryl beta naphthyl sulfonic acids, and alkaryl sulfonic acids such as dodecyl benzene "bottoms" sulfonic acids.

Dodecyl benzene "bottoms" sulfonic adds are the material leftover after the removal of dodecyl benzene sulfonic acids that are used for household detergents. These materials are generally alkylated with higher oligomers. The bottoms may be straight-chain or branched-chain alkylates with a straight-chain dialkylate preferred.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

The acidic organic compound of the basic metal salt may be a phenol. The phenols may be represented by the formula $(R_1)_a$—Ar—$(OH)_b$, wherein $R_1$ is defined above; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, or 1 to about 2. $R_1$ and a are preferably such that there is an average of at least about 8 aliphatic carbon atoms provided by the $R_1$ groups for each phenol compound.

While the term "phenol" is used herein, it is to be understood that this term is not intended to limit the aromatic group of the phenol to benzene. Accordingly, it is to be understood that the aromatic group as represented by "Ar", as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The term "phenol" as used herein also includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alkyl substituent containing about 3–100 and especially about 6–50 carbon atoms, such as heptylphenol, octylphenol, dodecylphenol, tetrapropene-alkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, etc.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

In one embodiment, the phenol is an alkylphenol sulfide. The alkylphenols from which the sulfide salts are prepared generally comprise phenols containing hydrocarbon substituents with at least about 6 carbon atoms; the substituents may contain up to about 7000 aliphatic carbon atoms. Also included are substantially hydrocarbon substituents, as defined hereinabove. The preferred hydrocarbon substituents are derived from the polymerization of olefins such as ethylene, propene, etc.

The term "alkylphenol sulfides" is meant to include di-(alkylphenol)monosulfides, disulfides, polysulfides, and other products obtained by the reaction of the alkylphenol with sulfur monochloride, sulfur dichloride or elemental sulfur. The molar ratio of the phenol to the sulfur compound can be from about 1:0.5 to about 1:1.5, or higher. For example, phenol sulfides are readily obtained by mixing, at a temperature above about 60° C., one mole of an alkylphenol and about 0.5–1 mole of sulfur dichloride. The reaction mixture is usually maintained at about 100° C. for about 2–5 hours, after which time the resulting sulfide is dried and filtered. When elemental sulfur is used, temperatures of about 200° C. or higher are sometimes desirable. It is also desirable that the drying operation be conducted under nitrogen or a similar inert gas.

Suitable basic alkyl phenol sulfides are disclosed, for example, in U.S. Pat. Nos. 3,372,116, 3,410,798 and 3,562,159 which are hereby incorporated by reference.

The metal compounds useful in making the basic metal salts (C) are generally any Group I or Group II metal compounds (CAS version of the Periodic Table of the Elements). The Group I metals of the metal compound include alkali metals (sodium, potassium, lithium, etc.) as well as Group IB metals such as copper. The Group I metals are preferably sodium, potassium, lithium and copper, or sodium or potassium, and or sodium. The Group II metals of the metal base include the alkaline earth metals (magnesium, calcium, barium, etc.) as well as the Group IIB metals such as zinc or cadmium. Preferably the Group II metals are magnesium, calcium, or zinc, preferably magnesium or calcium, or magnesium. Generally the metal compounds are delivered as metal salts. The anionic portion of the salt can be hydroxyl, oxide, carbonate, borate, nitrate, etc.

An acidic material is used to accomplish the formation of the basic metal salt (C). The acidic material may be a liquid such as formic acid, acetic acid, nitric acid, sulfuric acid, etc. Acetic acid is particularly useful. Inorganic acidic materials may also be used such as HCl, $SO_2$, $SO_3$, $CO_2$, $H_2S$, etc, preferably $CO_2$. A preferred combination of acidic materials is carbon dioxide and acetic acid.

A promoter is a chemical employed to facilitate the incorporation of metal into the basic metal compositions. Among the chemicals useful as promoters are water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include methanol, ethanol, isopropanol, dodecanol, behenyl alcohol, ethylene glycol, monomethylether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols.

Patents specifically describing techniques for making basic salts of the above-described sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. The disclosures of these patents are hereby incorporated in this present specification for their disclosures in this regard as well as for their disclosure of specific suitable basic metal salts.

Neutral or Basic Alkaline Earth Phenate or Aromatic-Carboxylate

In one embodiment, the manual transmission lubricants further comprise (D) at least one neutral or basic alkaline earth metal salt of at least one phenol or an aromatic acid, such as salicylate. In a preferred embodiment, (D) is a neutral or overbased phenate. The phenols and the salicylates are described above. When (D) is present in the manual transmission lubricant, then (D) is different from (C) the alkali or alkaline earth metal salt of the acidic organic compound. The alkaline earth salt (D) is present in an amount from about 0.1 to about 5, or from about 0.3 to 3, or from about 0.5 to about 2, or from about 0.5 to about 1.5 by weight.

Calcium and magnesium are the preferred alkaline earth metals. Salts containing a mixture of ions of two or more of these alkaline earth metals may be used. The salts which are useful as component (D) can be neutral or basic. The neutral salts contain an amount of alkaline earth metal which is just sufficient to neutralize the acidic groups present in the salt anion, and the basic salts contain an excess of the alkaline earth metal cation. Generally, the basic or overbased salts are preferred. The basic or overbased salts will have metal ratios described above or up to about 40 and more particularly from about 2 to about 30 or 40.

Oil of Lubricating Viscosity

The manual transmission lubricant and concentrate an oil of lubricating viscosity. The oil of lubricating viscosity is generally present in a major amount (i.e. an amount greater than about 50% by weight). In one embodiment, the oil of lubricating viscosity is present in an amount greater than about 60%, or greater than about 70%, or greater than about 80% by weight of the composition. The oils of lubricating viscosity include natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582, 618 (column 2, line 37 through column 3, line 63, inclusive), herein incorporated by reference for its disclosure to oils of lubricating viscosity.

In one embodiment, the oil of lubricating viscosity is a polyalpha-olefin (PAO). Typically, the polyalpha-olefins are derived from monomers having from about 3 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiment, the oil of lubricating viscosity are selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75W. The lubricating composition may also have a so-called multigrade rating such as SAE 75W-80, 75W-90, 75W-90, 75W-140, 80W-90, 80W-140, 85W-90, or 85W-140.

In one embodiment, the oil of lubricating viscosity is a mineral oil. The mineral oils have an iodine number of less than 9 and/or at least about 45% of the saturates present as aliphatic saturates. Iodine value is determined according to ASTM D-460. In one embodiment, the mineral oil has a iodine value less than about 8, or less than about 6, or less than about 4. The saturates level are determined by mass spectrometer. By mass spectroscopy, Group I stocks have about 70% saturates, Group II stocks have about 95% to about 98% saturates and Group III stocks have about 98%–100% saturates. Group II stocks have greater than 50% of their saturates present as cycloparaffinic compounds. The saturates of the mineral oils used in the present invention typically have at least about 45%, or at least about 50%, or at least about 60% aliphatic saturates. These aliphatic saturates are often referred to as paraffinic saturates. The cyclic saturates are generally referred to as cycloparaffinic saturates. Cyclic saturates compose the balance of the saturates in the mineral oils. The inventors have discovered that mineral oils having a higher proportion of aliphatic saturates have better oxidation properties and low temperature properties.

As use herein the term "mineral oil" refers to oils of lubricating viscosity which are derived from petroleum crude. The petroleum crudes may be subjected to processing such as hydroprocessing, hydrocracking, and isomerizing. Hydroprocessing includes processes such as sequential isocracking, isodewaxing and hydrofinishing. These mineral oils are those referred to as Group III basestock or base oils. In one embodiment, the mineral oil has less than 0.3% or less than 0.1% sulfur. In another embodiment, the oils of lubricating viscoisty generally have a viscosity index of 120 or more.

Examples of useful oils of lubricating viscosity include HVI and XHVI basestocks, such isomerized wax base oils and UCBO (Unconventional Base Oils) base oils. Specific examples of these base oils include 100N isomerized wax basestock (0.01% sulfur/141 VI), 120N isomerized wax basestock (0.01% sulfur/149 VI), 170N isomerized wax basestock (0.01% sulfur/142 VI), and 250N isomerized wax basestock (0.01% sulfur/146 VI); refined basestocks, such as 250N solvent refined paraffinic mineral oil (0.16% sulfur/89 VI), 200N solvent refined naphthenic mineral oil (0.2% sulfur/60 VI), 100N solvent refined/hydrotreated paraffinic mineral oil (0.01% sulfur/98 VI), 240N solvent refined/hydrotreated paraffinic mineral oil (0.01% sulfur/98 VI), 80N solvent refined/hydrotreated paraffinic mineral oil (0.08% sulfur/127 VI), and 150N solvent refined/hydrotreated paraffinic mineral oil (0.17% sulfur/127 VI). Further examples of the mineral oils include those Group III basestocks made by Texaco such as the TEXHVI stocks which include TEXHVI-100N (95% saturates, 125 viscosity index and 0.02% sulfur); TEXHVI-70N (97.8% saturates, 123 viscosity index and 0.02% sulfur); Texaco "MOTIVA" TEXHVI 90N-100N (100% saturates, 125 viscosity index and 0.01% sulfur); and "MOTIVA" TEXHVI 75N (100% saturates, 125 viscosity index and 0.0% sulfur). Examples of useful Group III basestocks made by Chevron include UCBO 200N (100% saturates, 142 viscosity index and 0.005% sulfur); UCBO 100N (100% saturates, 129 viscosity index, and 0.004% sulfur).

Polymers

Often the multigrade lubricant will have at least one polymer present. The polymer generally is present in an amount from about 3% to about 40%, or from about 5% to about 35%, or from about 10% to about 30% by weight of the lubricating composition. The polymers include a polyalkene or derivative thereof, an ethylene-α-olefin copolymer, an ethylene-propylene polymer, an α-olefin-unsaturated carboxylic reagent copolymer, a polyacrylate, a polymethacrylate, a hydrogenated interpolymer of an alkenylarene and a conjugated diene, and mixtures thereof. Here, and elsewherein the specification and claims, any member of a genus (or list) may be excluded from claims.

In one embodiment, the polymer is characterized-by an $\overline{M}w$ (weight average molecular weight) of less than about 50,000, or less than about 45,000, 'or less than about 40,000. In one embodiment, the polymer has an $\overline{M}w$ of less than about 25,000, or less than about 10,000, or less than about 7,000. Typically the polymer has an $\overline{M}w$ of at least about 1,000, or at least about 2,000, or at least about 3,000. In one embodiment, the polymer is characterized by an $\overline{M}n$ (number average molecular weight) of up to about 6000, or up to about 5000. Generally, the polymer is characterized by having an $\overline{M}n$ from about 800 to about 6000, or from about 900 to about 5000, or from about 1000 to 4000. In another embodiment, the polymers have a $\overline{M}n$ from about 1300 to about 5000, or from about 1500 to about 4500, or from about 1700 to about 3000. The polymers also generally have a $\overline{M}w/\overline{M}n$ from about 1.5 to about 8, or from about 1.8 to about 6.5, or from about 2 to about 5.5.

In one embodiment, the polymer may be a sheared polymer of higher molecular weight, e.g. greater than $\overline{M}w$ 50,000. In this embodiment, a higher molecular weight polymer is sheared to the desired molecular weight. The shearing may be done in any suitable apparatus, such as an extruder, an injector, an FZG apparatus, etc.

The abbreviation $\overline{M}w$ and $\overline{M}n$ is the conventional symbol representing weight average and number average molecular weight, respectively. Gel permeation chromatography (GPC) is a method which provides both molecular weights as well as the entire molecular weight distribution of the polymers. For purpose of this invention a series of fractionated polymers of isobutene, polyisobutene, is used as the calibration standard in the GPC. The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

In one embodiment, the polymer is a polyalkene. The polyalkene includes homopolymers and interpolymers of olefins having from 2 to about 40, or from 3 to about 24, or from 4 to about 12 carbon atoms. The olefins may be monoolefins, such as ethylene, propylene, 1-butene, isobutene, an α-olefin, or polyolefinic monomers, including diolefinic monomers, such 1,3-butadiene and isoprene. The α-olefins generally have from about 4 to about 30, or from about 8 to about 18 carbon atoms. These olefins are sometimes referred to as mono-1-olefins or terminal olefins. The α-olefins and isomerized α-olefins include 1-octene, 1-nonene, 1-ecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available α-olefin fractions that can be used include the $C_{15-18}$ α-olefins, $C_{12-16}$ α-olefins, $C_{14-16}$ α-olefins, $C_{14-18}$ α-olefins, $C_{16-18}$ α-olefins, $C_{16-20}$ α-olefins, $C_{18-24}$ α-olefins, $C_{22-28}$ α-olefins, etc. The polyalkenes are prepared by conventional procedures. The polyalkenes are described in U.S. Pat. No. 3,219,666 and 4,234,435, the disclosures of which is hereby incorporated by reference. Examples of polyalkenes includes polypropylenes, polybutylenes, polyisoprene and polybutadienes. In one embodiment, the polyalkene is a homopolymer, such as a polybutene. One example of a useful polybutene is a polymer where about 50% of the polymer is derived from isobutylene. Useful polybutenes include those having an $\overline{M}w$ of about 4,000 to about 8,000, preferably 6,700.

In one embodiment, the polyalkene is derived from one or more dienes. The dienes include 1,3 pentadiene, isoprene, methylisoprene, 1,4-hexadiene, 1,5-hepatadiene, 1-6-octadiene, 5-ethylidene-2-norbornene, 5-methylene-2-norbornene, linear 1,3-conjugated dienes (e.g. 1,3-butadiene, 2,3-dimethyl-1,3-butadiene, and 1,3-hexadiene) and cyclic dienes (e.g. cyclopentadiene, dicyclopentadiene, fulvene, 1,3-cyclohexadiene, 1,3,5-cycloheptatriene, and cyclooctatetraene). The polyalkene may be a homopolymer of a diene, or a co- or terpolymer of a diene with either another diene or one or more of the above monoolefins. The polyalkene may be hydrogenated. A commercially available polyalkene derived from at least one diene is LIR-290, a hydrogenated polyisoprene ($\overline{M}w$=25,000), available commercially from Kuraray Co, Ltd.

In another embodiment, the polymer is a derivative of a polyalkene. The derivatives are typically prepared by reacting one or more of the above polyalkenes or a halogenated derivative thereof with an unsaturated reagent. The halogenated polyalkenes are prepared by reacting a polyalkene with a halogen gas, such as chlorine. The preparation of these materials is known to those in the art. The unsaturated reagents include unsaturated amines, ethers, and unsaturated carboxylic reagents, such as unsaturated acids, esters, and anhydrides. Examples of unsaturated amines include unsaturated amides, unsaturated imides, and nitrogen containing acrylate and methacrylate esters. Specific examples of unsaturated amines include acrylamide, N,N'-methylene bis (acrylamide), methacrylamide, crotonamide, N-(3,6-diazaheptyl) maleimide, N-(3-dimethylaminopropyl) maleimide, N-(2-methoxyethoxyethyl) maleimide, N-vinyl pyrrolidinone, 2- or 4-vinyl pyridine, dimethylaminoethyl methacrylate and the like.

In one embodiment, the unsaturated carboxylic reagent is an acid, anhydride, ester, or mixtures thereof. If an ester is desired, it can be prepared by reacting an unsaturated carboxylic acid or anhydride with a polyalkene or halogenated derivative thereof and subsequently reacting the reaction product with an alcohol to form the ester. The unsaturated carboxylic reagents include acrylic acid, methacrylic acid, cinnamic acid, crotonic acid, 2-phenylpropenoic acid, maleic acid, maleic anhydride, fumaric acid, mesaconic acid, itaconic acid and citraconic acid maleic, fumaric, acrylic, methacrylic, itaconic, and citraconic acids, esters, and anhydrides (where possible). The esters may be represented by one of the formulae: $(R_1)_2C{=}C(R_1)C(O)OR_2$, or $R_2{-}(O)C{-}HC{=}CH{-}C(O)OR_2$, wherein each $R_1$ and $R_2$ are independently hydrogen or a hydrocarbyl group having 1 to about 30, or to about 12, or to about 8 carbon atoms, $R_1$ is hydrogen or an alkyl group having from 1 to about 6 carbon atoms. In one embodiment, $R_1$ is preferably hydrogen or a methyl group. In another embodiment, $R_2$ is an alkyl or hydroxyalkyl group having from about 1 to about 30, or from 2 to about 24, or from about 3 to about 18 carbon atoms. $R_2$ may be derived from one or more alcohols described below. Unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate and 2-ethylhexyl maleate. The above list includes mono- as well as diesters of maleic, fumaric, and itaconic acids and anhydrides.

The polyalkene derivatives are prepared by means known to those in the art. These materials have been referred to as hydrocarbyl substituted carboxylic acylating agents, and are discussed below. U.S. Pat. Nos. 3,219,666 and 4,234,435 describe the polyalkene derivatives and methods of making the same and are incorporated for such descriptions.

In another embodiment, the polymer is an ethylene-α-olefin copolymer. Typically, the copolymer is a random copolymer. The copolymer generally has from about 30% to about 80%, or from about 50% to about 75% by mole of ethylene. The α-olefins include butene, pentene, hexene or one more of the described above described α-olefins. In one embodiment, the α-olefin contains from about 3 to about 20, or from about 4 to about 12 carbon atoms. In one embodiment, the ethylene-α-olefin copolymers have an $\overline{M}w$ from about 10,000 up to about 40,000, or from about 15,000 up to about 35,000, or from about 20,000 up to about 30,000. In another embodiment, the ethylene-α-olefin copolymers have an $\overline{M}n$ from about 800 to about 6000, or from about 1500 to about 5000, or from about 2000 to about 4500. Examples of ethylene α-olefins copolymers include ethylene-butene copolymers and ethylene-octene copolymers. Examples of commercially available copolymers include Lucant HC 600 and Lucant HC 2000 ($\overline{M}w$=25,000), available from Mitsui Petrochemical Co., Ltd.

In another embodiment, the polymer is an ethylene propylene polymer. These polymers include ethylene propylene copolymers and ethylene propylene terpolymers. When the ethylene propylene polymer is an ethylene propylene copolymer (EPM, also called EPR polymers), it may be formed by copolymerization of ethylene and propylene under known conditions, preferably Ziegler-Natta reaction conditions. The preferred ethylene propylene copolymers contain units derived from ethylene in an amount from about 40% to about 70%, or from about 50% to about 60%, or about 55% by mole, the remainder being derived from propylene. The molecular weight distribution may be characterized by a polydispersity ($\overline{M}w/\overline{M}n$) from about 1 to about 8, or from about 1.2 to about 4.

In another embodiment, the ethylene propylene polymer is a terpolymer of ethylene, propylene and a diene monomer. In one embodiment, the diene is a conjugated diene. The dienes are disclosed above. The terpolymers are produced under similar conditions as those of the ethylene propylene copolymers. The preferred terpolymers contain units derived form ethylene in amount from about 10% to about 80%, or from about 25% to about 85%, or about 35% to about 60% by mole, and units derived from propylene in amount from about 15% to about 70%, or from about 30% to about 60% by mole, and units derived from diene third monomer in amount from about 0.5% to about 20%, or from about 1% to about 10%, or about 2% to about 8% by mole. The following table contains examples of ethylene propylene terpolymers.

| Example | Ethylene | Propylene | Diene |
|---|---|---|---|
| A | 42%* | 53% | 5% 1,5 heptadiene |
| B | 48% | 48% | 4% dicyclopentadiene |
| C | 45% | 45% | 10% 5-ethylidene-2-norbornene |
| D | 48% | 48% | 4% 1,6 octadiene |
| E | 48% | 48% | 4%, 4 cyclohexadiene |
| F | 50% | 45% | 4% 5-methylene-2-norbornene |

*Percentages are by mole

In one embodiment, the ethylene propylene polymer is a terpolymer of ethylene, propylene and dicyclopentadiene or ethylidene norbornene, available commercially as Trilene elastomers from the Uniroyal Corporation. A useful ethylene propylene terpolymer is Trilene CP-40. The ethylene propylene polymers are prepared by means know to those in the art. U.S. Pat. No. 3,691,078 describes ethylene propylene polymers and methods of preparing them, and is incorporated by reference for such disclosures.

In another embodiment, the polymer is a copolymer of an α-olefin and an unsaturated reagent. The α-olefins may be any of those discussed above, and include propylene, 1-butene, 2-methyl propene, 2-methyl-1-octene, and 1-decene. The unsaturated reagents are described above. The unsaturated carboxylic reagents include acrylates, methacrylates, maleates and fumarates. The α-olefin-unsaturated carboxylic reagent polymers are prepared by means known to those in the art. Examples of α-olefin-unsaturated carboxylic reagent copolymers include poly (octene-co-ethylacrylate), poly(decene-co-butylmethacrylate), poly(hexene-co-maleic anhydride), poly (octene-co-methyl fumarate) and the like.

In another embodiment, the polymer is a polyacrylate or polymethacrylate. The polyacrylates and polymethacrylates include homopolymers and interpolymers of one or more of the above described acrylic or methacrylic acids or esters. The polyacrylates and polymethacrylates include the Acryloid 1019 polymers, available from Rohm and Haas Company, Garbacryl 6335 available from Societe Francaise d'Organo-Sythese (SFOS), LZ 7720C available from The Lubrizol Corporation, and Viscoplex 0-101 polymers, available from Rohm Darmstadt.

In another embodiment, the polymer is a hydrogenated interpolymer of an vinyl substituted aromatic compound and a conjugated diene. The interpolymers include diblock, triblock and random block interpolymers. The vinyl substituted aromatic compounds generally have from about 8 to about 20, or from about 8 to about 18, or from about 8 to about 12 carbon atoms. Examples of vinyl substituted aromatics include styrene, α-methylstyrene, o-methylstyrene, m-methylstyrene, p-methylstyrene, p-t-butylstyrene, with styrene being preferred. The conjugated dienes are described above. Isoprene and 1,3-butadiene are preferred conjugated dienes.

The vinyl substituted aromatic content of these copolymers is in the range from about 20% to about 70%, or from about 40% to about 60% by weight. Thus, the conjugated diene content is in the range from about 30% to about 80%, or from about 40% to about 60% by weight. These interpolymers are prepared by conventional methods well known in the art. Such copolymers usually are prepared by anionic polymerization using, for example, an alkali metal hydrocarbon (e.g., sec-butyllithium) as a polymerization catalyst. Examples of suitable hydrogenated copolymers of a vinyl substituted aromatic compound and a conjugated diene include Shellvis 40, and Shellvis-50, both hydrogenated styrene-isoprene block copolymers, manufactured by Shell Chemicals.

Fluidizing Agent

The lubricating compositions may additionally contain at least one fluidizing agent. Generally, the fluidizing agent is present in an amount up to about 30% by weight. Typically the fluidizing agent is present in an amount from about 3% to about 30%, or from about 5% to about 28%, from about 10% to about 27%, or from about 15% to about 25% by weight of the lubricating composition. The amount of fluidizing agent equals the total amount of fluidizing agents in the lubricating compositions.

In one embodiment, the fluidizing agent is at least one member selected from the group consisting of an alkylated aromatic hydrocarbon, a naphthenic oil, a polyα-olefin having a kinematic viscosity from about 3 to about 20 cSt at 10° C., a carboxylic acid esters, and mixtures of two or more thereof. The alkylated aromatic hydrocarbons typically include mono- or di- (or mono-) substituted benzenes wherein the substituents are hydrocarbon-based groups having from about 8 to about 30, or from about 10 to about 14 carbon atoms. An example is Alkylate A-215 (a 237 molecular weight alkylated benzene) and Alkylate A-230 (a 230 molecular weight alkylated benzene) available from Monsanto.

The naphthenic oils are those derived from naphthenic crudes such as found in the Louisiana area. The viscosity of such naphthenic oils at 40° C. generally is less than 4 centistokes and more generally within the range of from about 3.0 to about 3.8 centistokes. At 100° C. the viscosity of the desirable naphthenic crudes is within the range of about 0.8 to about 1.6 centistokes.

The polyα-olefins (PAOs) are described above. Examples of useful PAOs include those derived from one or more of the above olefins, such as the α-olefins. These PAOs may have a viscosity from about 2 to about 30, or from about 3 to about 20, or from about 3 to about 8 cSt at 100° C. Examples of PAOs include 4 cSt polyα-olefins, 6 cSt polyα-olefins, and 8 cSt polyα-olefins. A particularly useful PAO is derived from decene.

The carboxylic ester fluidizing agents are reaction products of dicarboxylic esters with alcohols having from about 1 to about 30, or from about 2 to about 18, or from about 3 to about 12 carbon atoms. The alcohols are described below and include methyl, ethyl, propyl, butyl, hexyl, heptyl, octyl, decyl and dodecyl alcohols. The dicarboxylic acids generally contain from about 4 to about 18, or from about 4 to about 12, or from about 4 to about 8 carbon atoms. Examples of dicarboxylic acids include phthalic acid, succinic acid, alkyl ($C_{1-24}$)succinic acids, azelaic acid, adipic acid, and malonic acid. Particularly useful esters are dicarboxylic esters of $C_{1-12}$ alcohols, such as esters of propyl, butyl, pentyl, hexyl, and octyl alcohols and azelaic acid. In one embodiment, the lubricating compositions contain less than about 20%, or less than about 15% by weight of carboxylic ester fluidizing agent.

The above-described mineral oil may be used with commercially available gear and transmission concentrates such as those sold by Exxon, Lubrizol, Ethyl and Mobil corporations. In this embodiment, those commercial concentrates are diluted with the basestocks to form the transmission and gear formulations.

Antioxidants

In another embodiment, the manual transmission lubricant and the concentrates may contain one or more antioxidant. In one embodiment, the antioxidant is present in an amount from about 0.001% to about 5%, or from about 0.01% to about 2%, or from about 0.05% to about 1% by weight of the lubricating composition. The antioxidants may be present in a total amount generally from about 1.5% up to about 10%, or about 1.8% up to about 8%, or from about 1.9% up to about 6% by weight. In another embodiment, the lubricating composition contains at least about 1% by weight of an amine antioxidant, a dithiocarbamate antioxidant, or mixture thereof. In this embodiment, the lubricating compositions have at least about 1%, or from about 1.5%, or from about 1.7% by weight of an amine antioxidant, a dithiocarbamate antioxidant, or mixture thereof, preferably an amine antioxidant. In another embodiment, the antioxidant is present in an amount to deliver at least about 0.04%, or at least about 0.05%, or at least about 0.07% by weight nitrogen to the fully formulated lubricant, In another embodiment, the antioxidant include amine antioxidants, dithiophosphoric acid esters, phenol antioxidants, dithiocarbamates, phosphite antioxidants, sulfurized Diels-Alder adducts, and mixtures thereof. In one embodiment, the antioxidant is an amine antioxidant, or a dithiocarbamate antioxidant. In one embodiment, the antioxidants are ashless, i.e., free of metal. In another embodiment the antioxidant is other than a polyphenol.

Amine antioxidants include alkylated aromatic amines and heterocyclic amines. The alkylated aromatic amines include compounds represented by the formula $Ar^1$—$NR_1$—$Ar^2$, wherein $Ar^1$ and $Ar^2$ are independently mononuclear or polynuclear, substituted or unsubstituted aromatic groups; and $R_1$ is hydrogen, halogen, OH, $NH_2$, SH, $NO_2$ or a hydrocarbyl group having from 1 to about 50 carbon atoms. The aromatic group as represented by "Ar", as well as elsewhere in other formulae in this specification and in the appended claims, may be mononuclear or polynuclear. Examples of mononuclear Ar moieties include benzene moieties, such as 1,2,4-benzenetriyl; 1,2,3-benezenetriyl; 3-methyl-1,2,4-benzenetriyl; 2-methyl-5-ethyl-1,3,4-benzenetriyl; 3-propoxy-1,2,4,5-benzenetetrayl; 3-chloro-1,2,4-benzenetriyl; 1,2,3,5-benzenetetrayl; 3-cyclohexyl-1,2,4-benzenetriyl; and 3-azocyclopentyl-1,2,5-benzenetriyl, and pyridine moieties, such as 3,4,5-azabenzene; and 6-methyl-3,4,5-azabenzene. The polynuclear groups may be those where an aromatic nucleus is fused at two points to another aromatic nucleus, such as naphthyl and anthracenyl groups. Specific examples of fused ring aromatic moieties Ar include: 1,4,8-naphthylene; 1,5,8-naphthylene; 3,6-dimethyl-4,5,8(1-azonaphthalene); 7-methyl-9-methoxy-1,2,5,9-anthracenetetrayl; 3,10-phenathrylene; and 9-methoxy-benz(a)phenanthrene-5,6,8,12-yl. The polynuclear group may be those where at least two nuclei (either mononuclear or polynuclear) are linked through bridging linkages. These bridging linkages may be chosen from the group consisting of alkylene linkages, ether linkages, keto linkages, sulfide linkages, and polysulfide linkages of 2 to about 6 sulfur atoms. Specific examples of Ar when it is linked polynuclear aromatic moiety include: 3,3',4,4',5-bibenzenetetrayl; di(3,4-phenylene)ether; 2,3-phenylene-2,6-naphthylenemethane; and 3-methyl,9H-fluorene-1,2,4,5,8-yl; 2,2-di(3,4-phenylene)propane; sulfur-coupled 3-methyl-1,2,4-benzatriyl (having 1 to about 10 thiomethylphenylene groups); and amino-coupled 3-methyl-1,2,4-benzatriyl (having 1 to about 10 aminomethylphenylene groups). Typically Ar is a benzene nucleus, lower alkylene bridged benzene nucleus, or a naphthalene nucleus.

In another embodiment, the alkylated aromatic amine is represented by the formula $R_2$—Ar—NH—Ar—$R_3$, wherein $R_2$ and $R_3$ are independently hydrogen or hydrocarbyl groups having from 1 to about 50, or from about 4 to about 20 carbon atoms. Examples of aromatic amines include p,p'-dioctyldiphenylamine; octylphenyl-beta-naphthylamine; octylphenyl-α-naphthylamine, phenyl-α-naphthylamine; phenyl-beta-naphthylamine; p-octylphenyl-α-naphthylamine and 4-octylphenyl-1-octyl-beta-naphthylamine and di(nonylphenyl)amine, with di(nonylphenyl)amine preferred. U.S. Pat. Nos. 2,558,285; 3,601,632; 3,368,975; and 3,505,225 disclose diarylamines useful as antioxidant. These patents are incorporated herein by reference.

In another embodiment, the antioxidant may be a phenothiazine. Phenothiazines include phenothiazine, substituted phenothiazine, or derivatives, such as those represented by the formula (I)

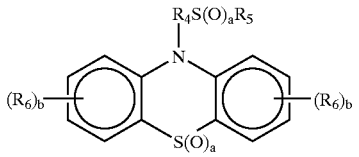

wherein $R_4$ is an alkylene, alkylene or an aralkylene group, or mixtures thereof, $R_5$ is selected from the group consisting of higher alkyl groups, or an alkenyl, aryl, alkaryl or aralkyl group and mixtures thereof; each $R_6$ is independently alkyl, alkenyl, aryl, alkaryl, arylalkyl, halogen, hydroxyl, alkoxy, alkylthio, arylthio, or fused aromatic rings, or mixtures thereof; a and b are each independently 0 or greater. In one embodiment, $R_4$ contains from about 2 to about 8, or two or three carbon atoms. $R_5$ typically contains from about 3 to about 30, or from about 4 to about 15 carbon atoms. $R_6$ contains from 1 to about 50, or from about 4 to about 30, or from 6 to about 20 carbon atoms.

In another embodiment, the phenothiazine derivatives may be represented by the formula (II)

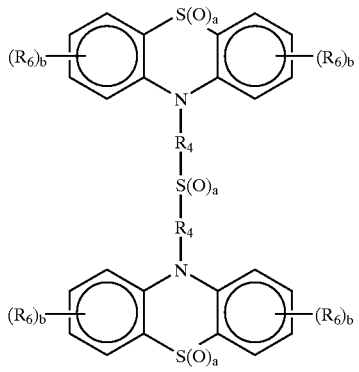

wherein $R_4$, $R_6$, a and b are as defined with respect to Formula I.

The above-described phenothiazine derivatives, and methods for their preparation are described in U.S. Pat. No.

4,785,095, and the disclosure of this patent is hereby incorporated by reference for its teachings of such methods and compounds. In one embodiment, a dialkyldiphenylamine is treated with sulfur at an elevated temperature such as in the range of 145° C. to 205° C. for a sufficient time to complete the reaction. A catalyst such as iodine may be utilized to establish the sulfur bridge.

Phenothiazine and its various derivatives may be converted to the above compounds by contacting the phenothiazine compound containing the free NH group with a thioalcohol of the formula $R_5SR_4OH$ where $R_4$ and $R_5$ are defined with respect to Formula I. The thioalcohol may be obtained by the reaction of a mercaptan (e.g. a $C_{4-30}$ mercaptan), such as hexanethiol, octanethiol and dodecanethiol, with an alkylene oxide, such as ethylene or propylene oxide under basic conditions. Alternatively, the thioalcohol may be obtained by reacting a terminal olefin, such as those described herein, with mercaptoethanol under free radical conditions. When it is desired to prepare compounds of the type represented by Formulae I and II wherein a is 1 or 2, i.e., sulfones or sulfoxides, the derivatives prepared by the reaction with the thioalcohols described above are oxidized with an oxidizing agent, such as hydrogen peroxide, in a solvent such as glacial acetic acid or ethanol under an inert gas blanket. The partial oxidation takes place conveniently at from about 20° C. to about 150° C.

In another embodiment, the antioxidant (A) is at least one phenol antioxidant. The phenol antioxidants include metal and metal free hindered phenols. Alkylene coupled derivatives of hindered phenols and phenol sulfides or sulfur coupled phenols may also be used. Hindered phenols are defined as those containing a sterically hindered hydroxyl group, and these include those derivatives of dihydroxy aryl compounds wherein the hydroxyl groups are in the o- or p-position to each other. The metal-free hindered phenols may be represented by the following formulae:

(III)

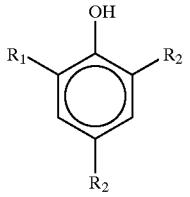

(IV)

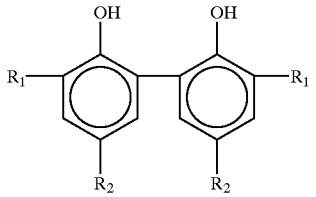

(V)

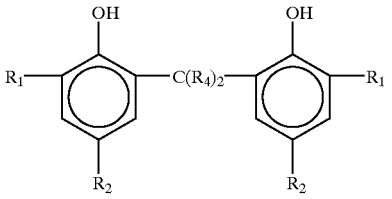

wherein each $R_1$ is independently a hydrocarbyl group containing from 3 to about 9 carbon atoms, each $R_2$ is hydrogen or a hydrocarbyl group, $R_3$ is hydrogen or a hydrocarbyl group containing from 1 to about 9 carbon atoms, and each $R_4$ is independently hydrogen or a methyl group. In one embodiment, $R_2$ is an alkyl group containing from about 3 to about 50, or from about 6 to about 20, or from about 6 to about 12 carbon atoms. In one embodiment alkyl groups are derived from one or more of the above polyalkenes. The alkyl groups may be derived from polymers of ethylene, propylene, 1-butene and isobutene, preferably propylene tetramer or trimer. Examples of $R_2$ groups include hexyl, heptyl, octyl, decyl, dodecyl, tripropenyl, tetrapropenyl, etc. Examples of $R_1$, $R_2$ and $R_3$ groups include propyl, isopropyl, butyl, sec-butyl, tert-butyl, heptyl, octyl, and nonyl. In another embodiment, each $R_1$ and $R_3$ are tertiary groups, such as tert-butyl or tert-amyl groups. The phenolic compounds may be prepared by various techniques, and in one embodiment, such phenols are prepared in stepwise manner by first preparing the para-substituted alkylphenol, and thereafter alkylating the para-substituted phenol in the 2- and/or 6-position as desired. When it is desired to prepare coupled phenols of the type represented by Formulae IV and V, the second step alkylation is conducted under conditions which result in the alkylation of only one of the positions ortho to the hydroxyl group. Examples of useful phenolic materials include: 2-t-butyl-4-heptylphenol; 2-t-butyl-4-octylphenol; 2-t-butyl4-dodecylphenol; 2,6-di-t-butyl-4-butylphenol; 2,6-di-t-butyl-4-heptylphenol; 2,6-di-t-butyl-4-dodecylphenol; 2,6-di-t-butyl-tetrapropenylphenol; 2-methyl-6-di-t-butyl-4-heptylphenol; 2,6-di-t-butyl-tripropenylphenol; 2,4-dimethyl-6-t-butylphenol; 2,6-t-butyl-4-ethylphenol; 4-t-butyl catechol; 2,4-di-t-butyl-p-cresol; 2,6-di-t-butyl-4-methylphenol; and 2-methyl-6-di-t-butyl-4-dodecylphenol. Examples of the ortho coupled phenols include: 2,2'-bis(6-t-butyl-4-heptylphenol); 2,2'-bis(6-t-butyl-4-octylphenol); 2,6-bis-(1'-methylcyclohexyl)-4-methylphenol; and 2,2'-bis (6-t-butyl-4-dodecylphenol).

Alkylene-coupled phenolic compounds may be prepared from the phenols by reaction of the phenolic compound with an aldehyde, typically those containing from one to about eight carbon atoms, such as formaldehyde or acetaldehyde, aldehyde precursors, such as paraformaldehyde or trioxane, or a ketone, such as acetone. The alkylene-coupled phenols may be obtained by reacting from 0.3 to about 2 moles a phenol with 1 equivalent of an aldehyde or ketone. Procedures for coupling of phenolic compounds with aldehydes and ketones are known to those in the art. Examples of phenolic compounds include 2,2'-methylenebis(6-t-butyl-4-heptylphenol); 2,2'-methylenebis(6-t-butyl-4-octylphenol); 2,2'-methylenebis(4-dodecyl6-t-butylphenol); 2,2'-methylenebis(4-octyl-6-t-butylphenol); 2,2'-methylenebis (4-octylphenol); 2,2'-methylenebis(4-dodecylphenol); 2,2'-methylenebis(4-heptylphenol); 2,2'-methylenebis(6-t-butyl-4-dodecylphenol); 2,2'-methylenebis(6-t-butyl-4-tetrapropenylphenol); and 2,2'-methylenebis(6-t-butyl-4-butyl phenol).

In another embodiment, the antioxidant is a metal-free (or ashless) alkylphenol sulfide or sulfur coupled phenols. The alkylphenols from which the sulfides are prepared also may comprise phenols of the type discussed above and represented by Formula III wherein $R_3$ is hydrogen. For example, the alkylphenols which can be converted to alkylphenol sulfides include: 2-t-butyl-4-heptylphenol; 2-t-butyl-4-octylphenol; and 2-t-butyl-4-dodecylphenol; 2-t-butyl-4-tetrapropenylphenol. The term "alkylphenol sulfides" is meant to include di-(alkylphenol) monosulfides, disulfides, and polysulfides, as well as other products obtained by the reaction of the alkylphenol with sulfur monochloride, sulfur dichloride or elemental sulfur. One mole of phenol typically is reacted with about 0.5–1.5 moles, or higher, of sulfur compound. For example, the alkylphenol sulfides are readily obtained by mixing, one mole of an alkylphenol and 0.5–2.0 moles of sulfur dichloride. The reaction mixture is usually maintained at about 100° C. for about 2–5 hours, after which time the resulting sulfide is dried and filtered. When elemental sulfur is used, temperatures from about 150–250° C. or higher are typically used. It is also desirable that the drying operation be conducted under nitrogen or a similar inert gas. A particularly useful alkylphenol sulfide is thio-bis (tetrapropenylphenate).

Suitable basic alkylphenol sulfides are disclosed, for example, in U.S. Pat. Nos. 3,372,116; 3,410,798; and 4,021,419, which are hereby incorporated by reference. These sulfur-containing phenolic compositions described in U.S. Pat. No. 4,021,419 are obtained by sulfurizing a substituted phenol with sulfur or a sulfur halide and thereafter reacting the sulfurized phenol with formaldehyde or an aldehyde precursor, e.g., paraformaldehyde or trioxane. Alternatively the substituted phenol may be first reacted with formaldehyde or paraformaldehyde and thereafter reacted with sulfur or a sulfur halide to produce the desired alkylphenol sulfide.

In another embodiment, the antioxidant is a dithiocarbamate antioxidant. The dithiocarbamate antioxidants include reaction products of a dithiocarbamic acid or salt and one or more of the above described unsaturated compounds, such as unsaturated amides, carboxylic acids, anhydrides, or esters, or ethers; alkylene-coupled dithiocarbamates; and bis(S-alkyldithiocarbamoyl) disulfides. In one embodiment, the dithiocarbamate compounds are ashless, i.e. metal free. The dithiocarbamates are described above.

Friction Modifiers

The lubricating compositions of the present invention may additionally contain a friction modifier selected from the group consisting of a fatty phosphite, a fatty acid amide, a fatty amine, a borated fatty amine, a borated fatty epoxide, a glycerol ester and a borated glycerol ester.

The fatty phosphites useful as friction modifiers in the present invention are generally dialkyl hydrogen phosphites having alkyl groups having from about 8 to about 24, preferably about 12 to about 22, or about 16 to about 20 carbon atoms in each alkyl group. A particularly useful fatty phosphite is a dioleyl hydrogen phosphite.

The fatty acid amides which are useful in the present invention are generally amides derived from fatty acids having from about 4 to about 28, preferably about 12 to about 22, preferably about 16 to about 20 carbon atoms. A particularly useful fatty acid amide is oleyl amide, linoleyl amide, stearyl amide or tall oil amide, with oleyl amide being preferred.

The fatty amines useful as friction modifiers are generally primary, secondary or tertiary amines having alkyl, alkoxyl or polyoxyalkene groups. Preferably the fatty amine is any of the fatty amines described under Component D-2 above, or the amine is an Ethomeen as described above.

The borated fatty amines are prepared by reacting a borating agent (described above) with a fatty amine (described above). The borated fatty amines are prepared by reacting the amine with the borating agent at about 50° C. to about 300° C., preferably about 100° C. to about 250° C., and at a ratio of 3:1 to 1:3 equivalents of amine to equivalents of borating agent.

The borated fatty epoxide useful as friction modifiers in the present invention are generally the reaction product of a boric acid or boron trioxide with at least one epoxide. The epoxide is generally an aliphatic epoxide having at least 8 carbon atoms, or from about 10 to about 20, or 12 to about 20. Examples of useful aliphatic epoxides include heptyl oxide, octyl oxide, stearyl oxide, oleyl oxide and the like. Mixtures of epoxides may also be used, for instance commercial mixtures of epoxides having from 14 to about 16 carbon atoms and 14 to about 18 carbon atoms.

The borated fatty epoxides are generally known and are disclosed in Canadian Patent 1,188,704 issued to Davis. This patent is incorporated by reference for its disclosure of borated fatty epoxides and methods for preparing the same.

The glycerol esters useful in the present invention are glycerol esters of fatty acids, such as fatty acids having from about 8 to about 22 carbon atoms, preferably about 12 to about 20. Examples of fatty acids useful in preparing the esters are oleic, stearic, linoleic acids and the like. The esters may be mono-, di-, or triesters of fatty esters. Glycerol mono-oleate and glycerol tallowate are known commercial materials. It is generally recognized that esters of glycerol are actually mixtures of mono- and diesters. A particularly useful ester is a mixture of mono- and diester containing at least 40% of the monoester of glycerol. Preferably, the mixtures of mono- and diesters of glycerol contain from about 40 to about 60% by weight of the monoester. For example, commercial glycerol monoleate contains a mixture of from about 45% to about 55% by weight monoester and from 55% to about 45% of the monoester. Glycerol monoleate in its commercially available mixtures are preferred.

The borated glycerol esters useful in-the present invention are prepared by reacting the fatty acid ester of glycerol with boric acid and removal of water. Preferably, the boric acid and the fatty acid ester are reacted such that each boron will react with from 1.5 to about 2.5 hydroxy groups present in the mixture.

The reaction may be carried out at a temperature in the range of from about 60° C. to about 135° C. in the absence or presence of any suitable organic solvent such as methanol, benzene, xylene, toluene, or the like.

U.S. Pat. No. 4,792,410, issued to Schwind et al, described friction modifiers and that disclosure is hereby incorporated by reference.

Other Additives

The invention also contemplates the use of other additives, such as, for example, detergents and dispersants, corrosion- and oxidation-inhibiting agents, pour point depressing agents, extreme pressure agents, auxiliary anti-wear agents, color stabilizers and anti-foam agents. The dispersant includes carboxylic dispersants (e.g. acylated amines and carboxylic esters), amine dispersants, Mannich dispersants, post treated dispersants and polymer dispersants. The carboxylic, amine and Mannich dispersants are discussed above.

The lubricants may also include a dispersant. The dispersants are known in the art. The following are illustrative.

(1) "Carboxylic dispersants" are the reaction products of carboxylic acids (or derivatives thereof) containing at least about 34 and preferably at least about 54 carbon atoms and nitrogen containing compounds (such as amine), organic hydroxy compounds (such as phenols and alcohols), and/or basic inorganic materials. These reaction products include imide, amide, and ester reaction products of carboxylic acylating agents. The carboxylic dispersants are generally prepared by reacting one or more of the above described hydrocarbyl substituted carboxylic acylating agent with an amine or hydroxy containing compound, such as an alcohol. Examples of these materials include succinimide dispersants and carboxylic ester dispersants. Examples of these "carboxylic dispersants" are described in British Patent 1,306,529 and in many U.S. Pat. Nos. including the following:

3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433.

(2) "Amine dispersants" are the reaction products of relatively high molecular weight aliphatic or alicyclic halides and amines, preferably polyalkylene polyamines. These dispersants are described above as polyalkene-substituted amines. Examples thereof are described for example, in the following U.S. Pat. Nos.: 3,275,554, 3,438,757, 3,454,555, and 3,565,804.

(3) "Mannich dispersants" are the reaction products of alkylphenols and aldehydes (especially formaldehyde) and amines (especially amine condensates and polyalkylenepolyamines). The materials described in the following U.S. Pat. Nos. are illustrative: 3,036,003, 3,236,770, 3,414,347, 3,448,047, 3,461,172, 3,539,633, 3,586,629, 3,591,598, 3,634,515, 3,725,480, 3,726,882, and 3,980,569.

(4) "Post-treated dispersants" are the products obtained by post-treating the carboxylic, amine or Mannich dispersants with reagents such as urea, thiourea, carbon disulfide, aldehydes, ketones, carboxylic acids, hydrocarbon-substituted succinic anhydrides, nitrites, epoxides, boron compounds, phosphorus compounds or the like. Exemplary materials of this kind are described in the following U.S. Pat. Nos.: 3,200,107, 3,282,955, 3,367,943, 3,513,093, 3,639,242, 3,649,659, 3,442,808, 3,455,832, 3,579,450, 3,600,372, 3,702,757,and 3,708,422.

(5) "Polymeric dispersants" are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants include esters of styrene-maleic anhydride copolymers. Examples thereof are disclosed in the following U.S. Pat. Nos.: 3,329,658, 3,449,250, 3,519,656, 3,666,730, 3,687,849, and 3,702,300.

The above-noted patents are incorporated by reference herein for their disclosures of dispersants.

Auxiliary extreme pressure and/or antiwear agents and corrosion- and oxidation-inhibiting agents may also be included together with the sulfurized combination of a fatty acid or ester and an olefin. The auxiliary extreme pressure and/or antiwear agents include sulfur compounds, such as sulfurized fattey acids, esters and olefins, and phosphorus or boron antiwear or extreme pressure agent.

Other antiwear and extreme pressure agents include chlorinated aliphatic hydrocarbons, such as chlorinated wax; phosphosulfurized hydrocarbons, such as the reaction product of a phosphorus sulfide with turpentine or methyl oleate; metal thiocarbamates, such as zinc dioctyldithiocarbamate, or barium diheptylphenyl dithiocarbamate; dithiocarbamate esters, such as reaction products of an amine (e.g., butylamine), carbon disulfide, and one or more of the above unsaturated amide, ester, acid, or ether, such as acrylic, methacrylic, maleic, or fumaric acids, esters, or salts and acrylamides; and dithiocarbamates, such as alkylene coupled dithiocarbamates, which include methylene or phenylene coupled bis(butyldithiocarbamates), and bis-(s-alkyldithiocarbamoyl) disulfides, which are known and referred to as sulfur-coupled thiocarbamates.

In one embodiment, the lubricating compositions and functional fluids contain one or more auxiliary extreme pressure and/or antiwear agents, corrosion inhibitors and/or oxidation inhibitors. Many of the above-mentioned extreme pressure agents and corrosion-oxidation inhibitors also serve as antiwear agents. In one embodiment, the lubricants are free of metal dithiophosphates, such as zinc dithiophosphates and/or chlorinated hydrocarbons, such as chlorinated wax.

The lubricating compositions and functional fluids may contain one or more pour point depressants, color stabilizers, metal deactivators and/or anti-foam agents. Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

These additional additives, when used, are present in the inventive lubricating and functional fluid compositions at sufficient concentrations to provide the compositions with enhanced properties depending upon their intended use. Generally, each of these additional additives are present in the lubricants and functional fluids at concentrations from about 0.01%, or from about 0.05%, or from about 0.5%. These additional additives are generally present in an amount up to about 20% by weight, or up to about 10% by weight, and or up to about 3% by weight.

In one embodiment, the lubricating compositions contain less than 2%, or less than 1.5%, or less than 1% by weight of a dispersant. In another embodiment, the lubricating compositions are free of lead based additives, metal (zinc) dithiophosphates, and alkali or alkaline earth metal borates.

In one embodiment, the lubricating compositions of the present invention are free of Group II basestocks. In another embodiment, the lubricating compositions are free of polyalphaolefin basestocks. In another embodiment, the lubricating compositions include a Group III brightstock. In yet another embodiment, the base stock is comprised of greater than 80%, or greater than 90% by weight of a Group III base stock.

The manual transmission lubricants are generally blended together at temperatures from room temperature to about 100° C. In one embodiment, the the metal thiophosphate and the basic salt are blended to form an intermediate then the phosphite is added to this intermediate. In the following table the metal thiophosphate is blended with the basic salt and then the phosphate is added.

The following examples relate to lubricating compositions which are gear oils and transmission fluids. Here, as well as elsewhere in the specification and claims, unless otherwise indicated, the amounts and percentages are by weight, the temperature is degrees Celsius, and the pressure is atmospheric pressure.

EXAMPLE 1

A manual transmission lubricant is prepared by blending into a manual transmission base stock, 1.2 parts of the Example A-6 with 0.4 parts of an oil solution of an overbased magnesium sulfonate (42% diluent oil, metal ratio 14.7, 9.4% magnesium, and 400 total base number) to form an intermediate, to this intermediate is added 0.5 parts of dibutyl phosphite.

EXAMPLES 2–3

Examples 2–3 are further examples of lubricating compositions which are blended with Chevron UCBO 4 centistoke Group III base stock,.

| | 2 | 3 |
|---|---|---|
| Product of Example A-14 | 1.4 | — |
| Product of Example A-15 | — | 1.62 |
| Magnesium sulfonate of Example 1 | 0.4 | 0.4 |
| Dibutyl phosphite | 0.5 | 0.5 |
| Calcium sulfurized phenate[1] | 0.5 | 0.6 |
| reaction product of polyisobutylene ($\overline{M}n$ = 850) succinic anhydride and diethylethanolamine | 0.3 | 0.3 |
| glycerol monooleate | 0.4 | 0.4 |
| Dinonyldiphenylamine | 2.8 | 2.8 |
| Polyisobutylene ($\overline{M}n$ = 850) succinic anhydride | 0.02 | 0.02 |
| Reaction product of polybutenyl ($\overline{M}n$ = 850) succinic anhydride and tetraethylene pentamine | 1.1 | 1.1 |
| Silicon antifoam | 0.002 | — |
| polyisobutylene ($\overline{M}n$ = 850) | 22.2 | 22.2 |
| ABM 215 | 5 | 5 |

[1]) Calcium sulfur coupled phenate having 38% diluent oil, metal ratio 3, 9.25% Ca and 255 total base number.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A manual transmission lubricant comprising a major amount of an oil of lubricating viscosity, (A) at least one metal thiophosphate, (B) at least one phosphite, (C) at least one basic salt of a phosphorus free acidic organic compound, and (D) at least one neutral or basic alkaline earth metal salt of a phenol or an aromatic carboxylic acid, component (D) being different than component (C), the manual transmission lubricant being free of barium salts.

2. The lubricant of claim 1 wherein the lubricant further comprises a polymer comprising a polyalkene or derivative thereof, an ethylene-α-olefin copolymer, an ethylene-propylene polymer, an α-olefin-unsaturated carboxylic reagent copolymer, a polyacrylate, a polymethacrylate, a hydrogenated interpolymer of an alkenylarene and a conjugated diene, or mixture of two or more thereof.

3. The lubricant of claim 1 further comprising a fluidizing agent comprising an alkylated aromatic hydrocarbon, a napthenic oil, a poly-α-olefin having a kinematic viscosity from about 3 to about 20 cSt at 100° C., a carboxylic acid ester, or a mixture of two or more thereof.

4. The lubricant of claim 1 wherein the lubricant further comprises an antioxidant.

5. The lubricant of claim 1 wherein the lubricant further comprises a friction modifier comprising a fatty phosphite, a fatty acid amide, a fatty amine, a borated fatty amine, a borated fatty epoxide, a glycerol ester, a borated glycerol ester, or a mixture of two or more thereof.

6. The lubricant of claim 1 wherein the lubricant further comprises a detergent, dispersant, corrosion-inhibiting agent, oxidation-inhibiting agent, pour point depressing agent, extreme pressure agent, antiwear agent, color stabilizer, anti-foam agent, or mixture of two or more thereof.

7. The lubricant of claim 1 wherein the oil of lubricating viscosity is a natural oil, synthetic oil, or a mixture thereof.

8. The lubricant of claim 1 wherein the oil of lubricating viscosity is a polyalpha-olefin.

9. The lubricant of claim 1 wherein the oil of lubricating viscosity has an iodine number that is less than 9.

10. The lubricant of claim 1 wherein the oil of lubricating viscosity comprises at least about 45% by weight aliphatic saturates.

11. The lubricant of claim 1 wherein (A) is a monothiophosphate, a dithiophosphate, or a mixture thereof.

12. The lubricant of claim 1 wherein the metal for (A) is a Group I metal, a Group II metal, aluminum, lead, tin, molybdenum, manganese, cobalt, nickel, or a mixture of two or more thereof.

13. The lubricant of claim 1 wherein the metal for (A) is zinc or copper.

14. The lubricant of claim 1 wherein (B) is a dihydrocarbyl phosphite or a trihydrocarbyl phosphite.

15. The lubricant of claim 1 wherein the acidic organic compound of (C) comprises an acid producing derivative of a carboxylic acid or a sulfonic acid selected from anhydride, lower alkyl ester, acyl halide, lactone or a mixture of two or more thereof.

16. The lubricant of claim 1 wherein the metal of (C) is a Group I metal or a Group II metal.

17. The lubricant of claim 1 wherein the aromatic carboxylic acid of (D) is a salicylic acid.

18. A manual transmission lubricant comprising a major amount of an oil or lubricating viscosity, (A) at least one zinc dialkyl dithiophosphate, (B) dibutyl phosphite, (C) a basic magnesium sulfonate, and (D) a basic calcium sulfur coupled phenate.

* * * * *